US011054089B2

(12) United States Patent
Klafta et al.

(10) Patent No.: US 11,054,089 B2
(45) Date of Patent: Jul. 6, 2021

(54) LIGHTING DEVICE WITH LENS

(71) Applicant: LEDVANCE GmbH, Garching bei Muenchen (DE)

(72) Inventors: Thomas Klafta, Maxhuette-Haidhof (DE); Marcel Vuc, Ingolstadt (DE); Josef Medl, Titting (DE)

(73) Assignee: LEDVANCE GMBH, Garching Bei Muenchen (DE)

( * ) Notice: Subject to any disclaimer, the term of this patent is extended or adjusted under 35 U.S.C. 154(b) by 0 days.

(21) Appl. No.: 15/669,329

(22) Filed: Aug. 4, 2017

(65) Prior Publication Data

US 2018/0038557 A1 Feb. 8, 2018

(30) Foreign Application Priority Data

Aug. 8, 2016 (DE) ..... 10 2016 114 643.9

(51) Int. Cl.

| | |
|---|---|
| ***F21K 9/237*** | (2016.01) |
| ***F21K 9/60*** | (2016.01) |
| ***F21K 9/90*** | (2016.01) |
| ***F21V 5/04*** | (2006.01) |
| ***F21S 2/00*** | (2016.01) |
| *F21K 9/69* | (2016.01) |
| *F21K 9/66* | (2016.01) |
| *F21Y 115/10* | (2016.01) |
| *F21V 17/06* | (2006.01) |
| *F21V 17/16* | (2006.01) |
| *F21V 19/00* | (2006.01) |

(52) U.S. Cl.

CPC ..... *F21K 9/60* (2016.08); *F21K 9/237* (2016.08); *F21K 9/90* (2013.01); *F21S 2/005* (2013.01); *F21V 5/04* (2013.01); *F21V 5/045* (2013.01); *F21K 9/66* (2016.08); *F21K 9/69* (2016.08); *F21V 17/06* (2013.01); *F21V 17/164* (2013.01); *F21V 19/003* (2013.01); *F21Y 2115/10* (2016.08)

(58) Field of Classification Search

CPC ..... F21K 9/66; F21K 9/69; F21K 9/60; F21K 9/237; F21K 9/90; F21V 5/04; F21V 5/045; F21V 17/06; F21V 17/164; F21V 19/003; F21S 2/005

See application file for complete search history.

(56) References Cited

U.S. PATENT DOCUMENTS 4,254,453 A * 3/1981 Mouyard ..... G09F 13/22 340/815.54
6,637,921 B2 * 10/2003 Coushaine ..... F21V 7/0008 362/517
7,401,960 B2 * 7/2008 Pond ..... B60Q 1/04 362/545

(Continued)

FOREIGN PATENT DOCUMENTS

| | | |
|---|---|---|
| DE | 102016203405 A1 | 9/2017 |
| EP | 2306068 A1 | 4/2011 |
| EP | 2765351 A1 | 8/2014 |

*Primary Examiner* — Arman B Fallahkhair
(74) *Attorney, Agent, or Firm* — Hayes Soloway PC

(57) ABSTRACT

A lighting device (in particular an MR-16 or a PAR-16 lamp) comprises a housing and a lens. A light module having a light source and a driver is attached to the lens. The lens is connected to the housing by means of a snap-on connection or by means of a formed (thermally, for example) edge section.

23 Claims, 2 Drawing Sheets

(56) References Cited

U.S. PATENT DOCUMENTS

| | | | | |
|---|---|---|---|---|
| 7,712,922 | B2 * | 5/2010 | Hacker | F21V 15/01 362/191 |
| 8,303,148 | B2 * | 11/2012 | Frey | F21V 19/0035 362/548 |
| 8,436,375 | B2 * | 5/2013 | Miura | F21V 15/013 257/678 |
| 8,485,687 | B2 * | 7/2013 | McQuistian | F21V 7/0083 362/230 |
| 8,662,704 | B2 * | 3/2014 | Carraher | F21S 8/08 362/242 |
| 8,740,417 | B2 * | 6/2014 | Jiang | F21V 5/04 362/296.05 |
| 8,960,957 | B2 * | 2/2015 | Long | F21V 5/04 362/249.02 |
| 9,429,295 | B2 * | 8/2016 | Ahn | F21V 29/02 |
| 9,797,571 | B2 * | 10/2017 | Adams | F21V 5/007 |
| 2008/0198604 | A1 * | 8/2008 | Kim | F21V 5/008 362/293 |
| 2010/0103675 | A1 * | 4/2010 | Yu | F21V 29/773 362/253 |
| 2014/0003058 | A1 | 1/2014 | Long | |
| 2014/0239336 | A1 | 8/2014 | Streppel et al. | |
| 2014/0313731 | A1 * | 10/2014 | Kwak | F21V 29/004 362/294 |
| 2017/0276297 | A1 * | 9/2017 | Sorensen | F21K 9/238 |

* cited by examiner

LIGHTING DEVICE WITH LENS

TECHNICAL FIELD

The present invention relates to a lighting device, in particular a retrofit lighting device with a housing and a lens through which the light generated by a light module inside the housing can leave the lighting device. The invention relates in particular to the mechanical connection between light module, lens and housing. The invention is applicable in particular to LED retrofit lamps for replacing halogen reflector lamps, in particular MR16 and PAR16 lamps.

BACKGROUND OF THE INVENTION

An LED reflector lamp has previously been laboriously assembled from a plurality of components in a plurality of work steps on a production line or manually. In this process, an electronic driver is first inserted into a housing comprising the reflector. Then an LED unit, if necessary with a heat sink, is inserted and connected to the driver. Subsequently, a lens is inserted and fixed with a lens holder.

Fastening of the individual components can be carried out using adhesive, screws, latches, etc. Corresponding fastening surfaces, undercuts or similar must be provided in the housing for this purpose. Usually, a specific machine is present for each fastening step in an automated line. Especially in case of adhering or bonding, an appropriate waiting time must always be provided for curing of the adhesive. This reduces the throughput rate of a production line.

The object of the present invention is therefore to provide an improved way of fastening the components of a lighting device.

SUMMARY OF THE INVENTION

This object is achieved by a lighting device and a method for producing a lighting device according to the independent claims. Preferred embodiments can be derived in particular from the dependent claims.

A lighting device according to the present invention comprises a housing inside which a light module is arranged. The light generated by the light module can leave the housing through a light exit opening. The light exit opening is at least partially covered by a lens which, in addition to protecting the components arranged inside the lighting device, is used in particular for shaping the emerging light profile. The lens can be completely transparent in design but it can also have sections that are only partially transparent or even opaque. Such sections can serve, for example, as decorative elements. In one embodiment, the edge of the lens in particular is opaque.

In contrast to the prior art, in which the electronic components, i.e. the light module in particular, are fastened in the house first, the housing subsequently being sealed with the lens, in the lighting device according to the invention the light module is connected to the lens, for example by means of a snap-on connection, by bonding, screwing, laser welding, heat staking or by means of other known fastening processes. The lens, in turn, is connected to the housing as described below.

This enables the light module to be easily mounted on the lens. The unit comprising light module and lens can then simply be inserted in the housing and the lens can be simply connected to the housing.

Due to the fact that the individual components of the lighting device no longer each have to be installed individually in the housing, the effort for assembling the lighting device according to the invention is reduced. Production of the individual components is also simplified since tolerances can be rougher and there is no need to provide undercuts, locating surfaces, etc. inside the housing for fastening individual components.

The connection between lens and housing can be made according to the invention by means of a snap-on connection or by forming at least one section of the lens.

The present invention thus makes it possible to dispense with bonding the lens to the housing. As a result, the production time for a lighting device decreases since there is no need to wait for any adhesive used to cure.

If the lens is connected to the housing by way of a snap-on connection, both the lens and the housing can have corresponding snap-fit elements (for example, snap tabs, undercuts, etc.). When the lens and housing are assembled, they snap into each other and thus ensure the lens is fastened to the housing.

If the connection is created by way of a formed lens section, at least one edge section of the lens is preferably formed in such a way that it engages with corresponding sections of the housing and the lens and thereby connects said lens to said housing.

Forming of the lens section is preferably effected by means of a thermal process, i.e. the lens section is heated to a temperature at which the material of the lens section becomes plastically deformable. Subsequently, the lens section is formed in such a way that it establishes the connection to the housing.

In a preferred embodiment, the lighting device comprises an anti-rotation means which prevents the lens from rotating relative to the housing. The anti-rotation means can be formed on the housing independently of the fastening of the lens. For example, it can be implemented by corresponding structures on lens and housing. However, the anti-rotation means can also be integrated into the fastening of the lens to the housing.

For example, in the case of a snap-on connection, the interaction between one or a plurality of snap tabs on the lens and the corresponding snap-fit elements on the housing can prevent the lens from rotating relative to the lens. In the case of connecting by forming the lens edge, an anti-rotation means can be implemented in that the housing wall has, for example, protrusions which engage in the formed lens edge and thus prevent the lens from rotating relative to the housing.

In a preferred embodiment, the light source of the lighting device according to the invention is a semiconductor light source, for example one or a plurality of LEDs. The lighting device according to the invention can thus be used as a so-called retrofit lamp.

In a further preferred embodiment, the light module comprises an electronic driver for the semiconductor light source. This driver can then be introduced into the housing together with the light source during assembly of the light module attached to the lens and can be connected to said light module. The electrical connections of the driver can protrude out of the housing through openings at the end of the housing opposing the light exit opening and can be connected there, for example, to corresponding contact pins (e.g. by crimping). This is shown, for example, in the German patent application DE 10 2016 203 405 the disclosure of which is incorporated herein in its entirety by reference.

In a further preferred embodiment, the lighting device is an MR16 or a PAR 16 lamp, in particular an MR16 or a PAR16 retrofit lamp.

The present invention further relates to a method for producing a lighting device, as described above. According to the invention, the light module is connected to the lens (for example, by means of a snap-on connection) in a first step and is then connected to the housing in a second step.

Connecting of the lens to the housing can be effected by engaging one or a plurality of snap-fit elements of the lens with one or a plurality of corresponding snap-fit elements of the housing. Snap tabs and corresponding undercuts can be used, for example, as snap-fit elements.

Connecting of the lens to the housing can also be effected by forming at least one lens section. In particular, the lens section can be formed thermally. By forming the lens section (preferably an edge section of the lens), the lens section is connected to a corresponding housing section in a positive locking manner.

The properties, features and advantages of this invention described above and the way in which they are achieved, will be more clearly and distinctly understood in conjunction with the following schematic description of embodiments which will be explained in greater detail in connection with the drawings. For the sake of clarity, identical or equivalent elements can be provided with the same reference numbers.

DETAILED DESCRIPTION

Figure 1:
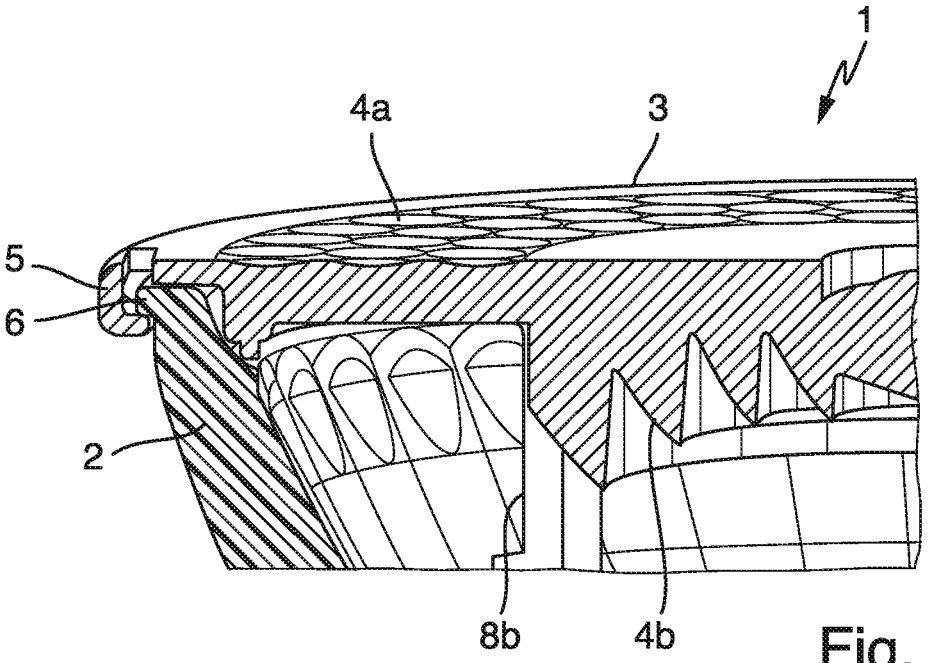
FIG. 1 shows a detail of a sectional view of a first embodiment of a lighting device according to the invention.

FIG. 1 shows a detail of a sectional view of an embodiment of an LED MR16 retrofit lamp 1 according to the invention. The retrofit lamp 1 comprises a housing 2, the light exit opening of which is sealed with a transparent lens 3. The lens 3 is provided with structures 4*a*, 4*b* which are used to create a uniform distribution of light outside the housing. A plurality of snap-fit elements 5 are provided on the edge of the lens. When the lens 3 is fitted onto the housing 2, the snap-fit elements 5 snap behind a protrusion 6 on the edge of the housing 2. As a result, the lens 3 is connected to the housing 2.

The protrusion 6 can be provided around the entire edge of the housing 2 which surrounds the light exit opening.

Accordingly, when fitting the lens 3 to the housing 2, there is no need to maintain any particular alignment between these two elements. However, the protrusion can also be provided only at the points corresponding to the snap-fit elements 5.

Figure 2:
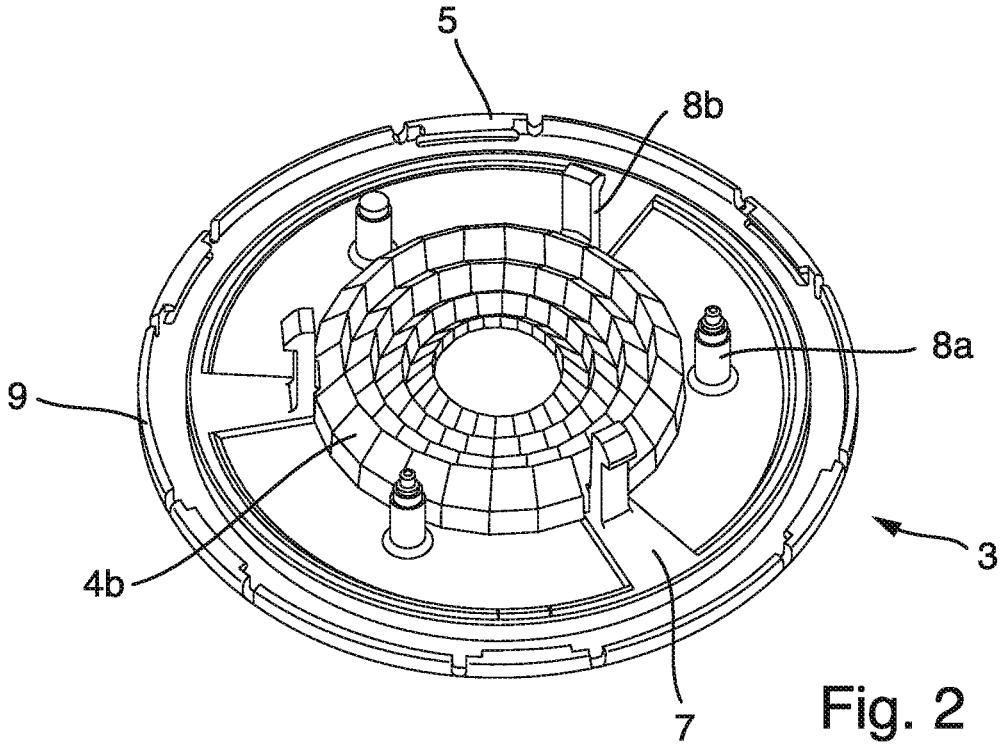
FIG. 2 shows a perspective view of a lens of the first embodiment.

FIG. 2 shows a perspective view of the lens 3 illustrated in FIG. 1. The fastening elements for attaching the light module to the lens can be seen in this diagram. The light module can be fitted onto retaining pins 8*a*, which prevent the light module from rotating relative to the lens 3, and can be connected to the lens 3 by means of snap-fit elements 8*b*. In addition to the snap-fit elements 8*b*, the lens 3 comprises thickenings 7 extending radially outwards which may be transparent in design. These thickenings 7 are used to absorb the forces arising on the lens 3 during assembly of the light module.

The lens 3 illustrated in FIG. 2 comprises six snap-fit elements 5. It is also conceivable that a lens 3 is provided with three, four, five or even more snap-fit elements 5. The edge region 9 of the lens 3 between the individual snap-fit elements 5 is bent by 90° in the embodiment illustrated.

Figure 3:
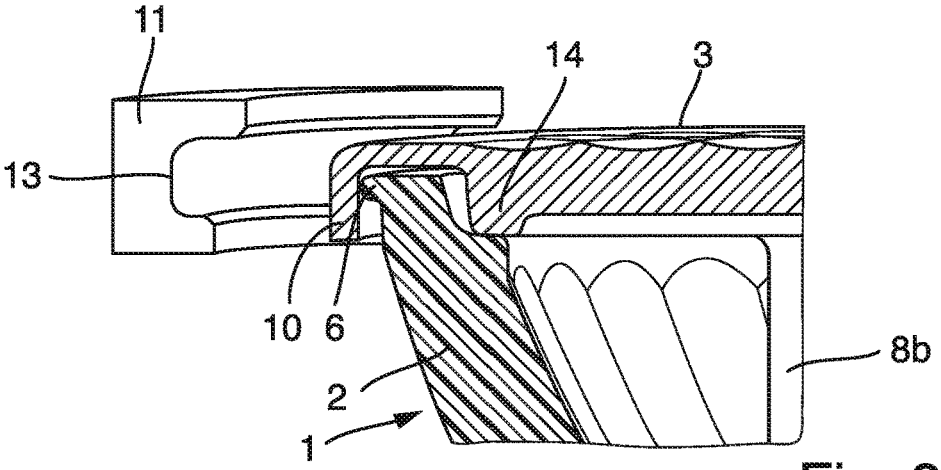
FIG. 3 shows a detail of a sectional view of a second embodiment of a lighting device according to the invention before the forming process.

FIG. 3 shows a detail of a sectional view of a further embodiment of an LED MR16 retrofit lamp 1 according to the invention before the forming process. The retrofit lamp 1 comprises a housing 2, the light exit opening of which is sealed with a transparent lens 3. According to the previous embodiment, the lens 3 can be provided with structures which are used to create a uniform distribution of light outside the housing.

It can be seen in the diagram shown in FIG. 3 how the lens 3 of the lighting device 1 is mounted on the housing 2. At this time point, there is not yet any firm connection between the housing 2 and the lens 3. The edge of the lens 3 is designed as a collar 10 which is bent at a 90° angle. This creates a "channel" between the collar 10 and the inner part 14 of the lens. This channel is used to arrange lens 3 on the edge of the housing 2.

Figure 4:
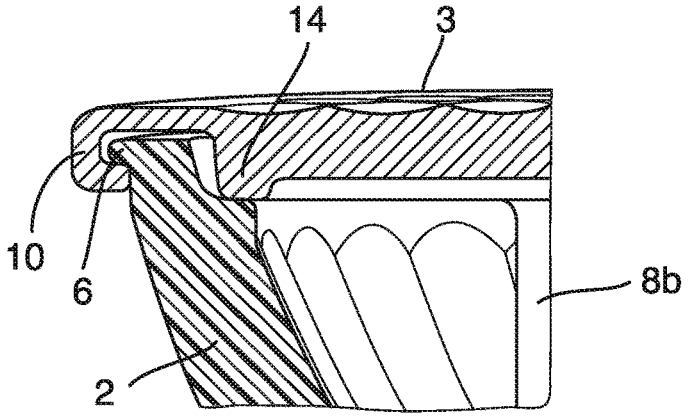
FIG. 4 shows a detail according to FIG. 3 after the forming process.

The edge of the housing 2 is provided with a circumferential protrusion 6 in the form of a flange. As illustrated in FIG. 4, the collar 10 on the edge of the lens 3 engages under this protrusion 6 in the formed state. This results in a firm connection between the lens 3 and the housing 2.

The forming of the edge occurs by heating the collar 10 by means of a former 11 (made of metal, for example). By heating up, the material of the collar 10 is brought to a temperature which allows the collar 10 to be plastically deformed. Deformation of the collar 10 can essentially take place at the same time as the heating by the former 11, which has an inner profile 13 that corresponds to the shape of the formed edge. When the heated former 11 is pressed against the edge of the lens 3, the material of the lens 3 in the contact area is first heated and brought into the desired shape with continued pressure.

After the forming is complete, the former 11 is removed again from the edge of the lens 3. The heated lens material can cool down and the lens edge solidifies in the formed configuration in which the edge, i.e. the formed collar 10, encloses the protrusion 6 on the housing 2.

Figure 5:
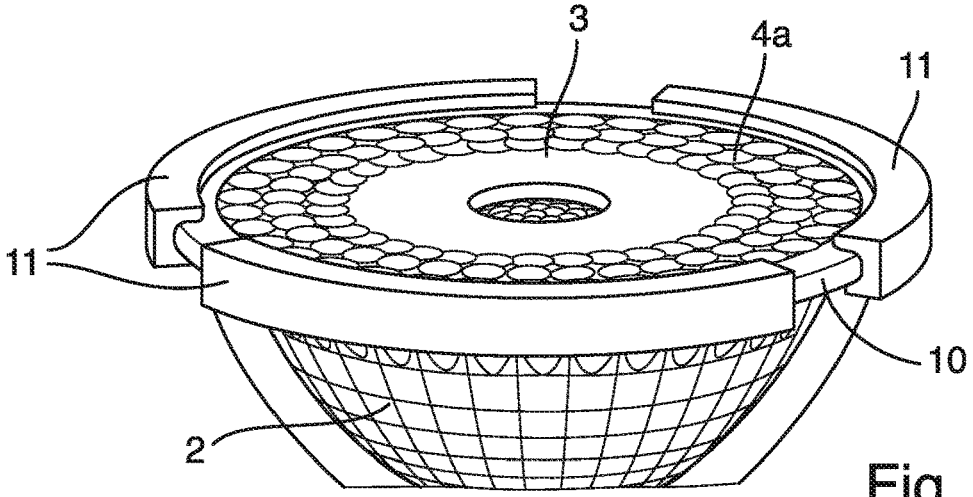
FIG. 5 shows a perspective view of the second embodiment during the forming process.

As can be seen from FIG. 5, forming of the lens edge can take place at one or a plurality of points on the edge. In particular, it is not necessary for the entire edge of the lens 3 to be formed. FIG. 5 shows three formers 11, each of which covers an area of approximately 100°. It is equally possible to use only two formers 11 (for example, at opposing points of the edge) or even four or more formers 11. The angular area covered by each former 11 must be adjusted accordingly if necessary. With three formers 11, each former 11 can also cover an area between approximately 90° and approximately 110°, likewise each former 11 can cover only an area of approximately 10° to approximately 20°.

Although the invention has been illustrated and described in greater detail using the embodiments shown, the invention is not limited thereto and a person skilled in the art may derive other variations therefrom without departing from the scope of protection of the invention.

Generally, "one" may be understood to mean a single figure or a plurality, particularly in the sense of "at least one"

or "one or more", etc., as long as this is not explicitly excluded, e.g. by the expression "exactly one".

A specified figure may also include exactly the number and also a customary tolerance range, as long as this is not explicitly excluded.

Features of different embodiments can be combined with one another to the extent that this is technically feasible.

LIST OF REFERENCE NUMERALS

1 Lighting device
2 Housing
3 Lens
4*a*, 4*b* Lens structures
5 Snap-fit element
6 Protrusion
7 Thickening
8*a*, 8*b* Fastening elements
9 Edge region of the lens
10 Collar
11 Former
13 Inner profile of the former
14 Inner part of the lens

The invention claimed is:

1. A lighting device comprising:
a housing with a light exit opening; and
a lens, which is physically connected to the housing, extends over an outer peripheral portion of the housing, and at least partially covers said light exit opening, wherein the lens includes:
at least one fastening element extending therefrom into an interior of the housing, wherein the at least one fastening element is configured to physically attach a light module to the lens such that the lens and the light module are engageable together as an assembly with the housing; and
at least one anti-rotation element extending therefrom into the interior of the housing, wherein the at least one anti-rotation element comprises a physical structure configured to have the light module fitted thereon such that the light module does not rotate with respect to the lens;
wherein the at least one fastening element and the at least one anti-rotation element are configured differently at least in that they are structurally dissimilar from one another.

2. The lighting device according to claim 1, wherein the lens is physically connected to the housing, engaged with the exterior portion of the housing, by means of a snap-on connection provided by physical engagement between:
at least one snap-fit element of the lens; and
at least one corresponding snap-fit element of the housing which is at least partially situated at the exterior portion of the housing.

3. The lighting device according to claim 2, wherein the at least one snap-fit element of the lens is provided at an outermost edge of the lens.

4. The lighting device according to claim 3, wherein the lens further comprises at least one edge portion at the outermost edge of the lens, disposed between consecutive snap-fit elements of the lens.

5. The lighting device according to claim 4, wherein the at least one edge portion is bent at an angle of substantially 90°.

6. The lighting device according to claim 2, wherein the at least one corresponding snap-fit element of the housing comprises a protrusion provided around an entire edge of the housing.

7. The lighting device according to claim 2, wherein the at least one corresponding snap-fit element of the housing comprises at least one protrusion provided around less than an entire edge of the housing.

8. The lighting device according to claim 2, wherein the at least one snap-fit element of the lens extends from the lens in a first direction and then in a second direction radially inward.

9. A method for producing a lighting device according to claim 1, the method comprising:
physically attaching the lens and the light module as the assembly; and
subsequently physically connecting the assembly to the housing such that at least the lens is engaging the exterior portion of the housing.

10. The method according to claim 9, wherein the lens is physically connected to the housing, engaging the exterior portion of the housing, by forming at least one lens section.

11. The method according to claim 10, wherein said forming is thermal forming of at least one edge section of the lens.

12. The method according to claim 9, wherein the lens is physically connected to the housing, engaging the exterior portion of the housing, by engaging one or a plurality of snap-fit elements of the lens with one or a plurality of corresponding snap-fit elements of the housing which are at least partially situated at the exterior portion of the housing.

13. The lighting device according to claim 1, wherein the lens is physically connected to the housing, engaged with the exterior portion of the housing, by at least one formed lens section.

14. The lighting device according to claim 13, wherein the formed lens section is a thermally formed edge section of said lens.

15. The lighting device according to claim 13, wherein the housing comprises an edge section which is at least partially situated at the exterior portion of the housing and which engages in the formed lens section.

16. The lighting device according to claim 1, wherein:
the at least one fastening element comprises a snap-fit tab portion configured to snap into engagement with at least one corresponding snap-fit feature of the interior of the housing; and
the physical structure comprises a retaining pin.

17. The lighting device according to claim 16, wherein the lens is physically connected to the housing, engaged with the exterior portion of the housing, by means of a snap-on connection provided by physical engagement between:
at least one snap-fit element of the lens; and
at least one corresponding snap-fit element of the housing which is at least partially situated at the exterior portion of the housing.

18. The lighting device according to claim 1, further comprising an anti-rotation means which prevents the lens from rotating relative to the housing.

19. The lighting device according to claim 1, wherein the lighting device is configured as:
an MR16 or a PAR16 lamp; or
an MR16 or a PAR16 retrofit lamp.

20. The lighting device according to claim 1, wherein the at least one fastening element comprises at least one retaining pin configured to have the light module fitted thereon.

21. The lighting device according to claim 1, wherein the lens further comprises at least one thickened portion extending radially outward and configured to absorb forces arising on the lens in physically connecting the light source to the lens.

22. The lighting device according to claim 1, wherein the lens is of single-piece construction.

23. The lighting device according to claim 1, wherein the at least one fastening element and the at least one anti-rotation element are formed integrally with a body portion of the lens.

* * * * *